United States Patent [19]

Harrison

[11] 3,952,670

[45] Apr. 27, 1976

[54] RAILWAY VEHICLE PRIMARY SUSPENSIONS

[75] Inventor: Reginald Harrison, Oadby, England

[73] Assignee: Dunlop Limited, London, England

[22] Filed: July 24, 1974

[21] Appl. No.: 491,245

[30] Foreign Application Priority Data

Aug. 1, 1973 United Kingdom ..... 36507/73

[52] U.S. Cl. ..... 105/224.1

[51] Int. Cl.[2] ..... B61F 5/26

[58] Field of Search..... 267/3; 105/224 R, 224.1

[56] References Cited

UNITED STATES PATENTS 2,802,662 8/1957 Hirst ..... 105/224.1 X

FOREIGN PATENTS OR APPLICATIONS 1,267,910 5/1968 Germany ..... 105/224.1

*Primary Examiner*—John J. Love

*Attorney, Agent, or Firm*—Stevens, Davis, Miller & Mosher

[57] ABSTRACT

A railway vehicle having a primary suspension with a reduced longitudinal stiffness at the axle comprising a downwardly inclined pair of longitudinally opposed elastomeric material springs mounted to the axlebox such that the axis of the axleset is substantially vertically displaced from the plane of action of the resultant longitudinal stiffness of the suspension.

5 Claims, 2 Drawing Figures

RAILWAY VEHICLE PRIMARY SUSPENSIONS

This invention relates relaes to railway vehicle suspensions and in particular to a primary suspension of elastomeric material acting at the axlebox of a vehicle.

Conventional axlebox suspensions of this type comprise a pair of elastomeric material springs arranged longitudinally of the vehicle and one at either side of the axlebox. The springs are inclined downwardly towards the axis of the axle and are stressed both in shear and compression under the weight of the vehicle. Variaton of the spring dimensions and the downward inclinaton allow some adjustment of the suspension characteristics but the ratio between the vertical, longitudinal and lateral stiffness of the suspension is typically 1:4:2. Consequently the longitudinal stiffness is high which provides for effective axle location.

However, in some cases, for example where a degree of self steering is required, it would be advantageous if the longitudinal stiffness could be reduced and one object of the present invention is to provide a means of selectively reducing the longitudinal stiffness of the suspension.

According to one aspect of the present invention a railway vehicle including a primary suspension comprising a downwardly inclined pair of longitudinally opposed springs of elastomeric material each mounted at their lower end upon an axlebox supporting an axleset and adapted for connection at the other end to the vehicle body is provided wherin the axis of the axleset is substantially vertically displaced from the plane of action of the resultant longitudinal stiffness of the suspenson so that the effective longitudinal stiffness at the axle is reduced.

The axis of the axle is preferably raised vertically above the plane of action of the resultant longitudinal stiffness and this can be achieved by providing on the axlebox downwardly extending extensions, one on either side of the axlebox, for abutment by the springs.

The elastomeric springs may be of the rubber-bonded to metal type with or without bonded interleaving plates of metal and the springs may be of the flat or chevron type (i.e. V-shaped rubber blocks and plates).

Figure 1:
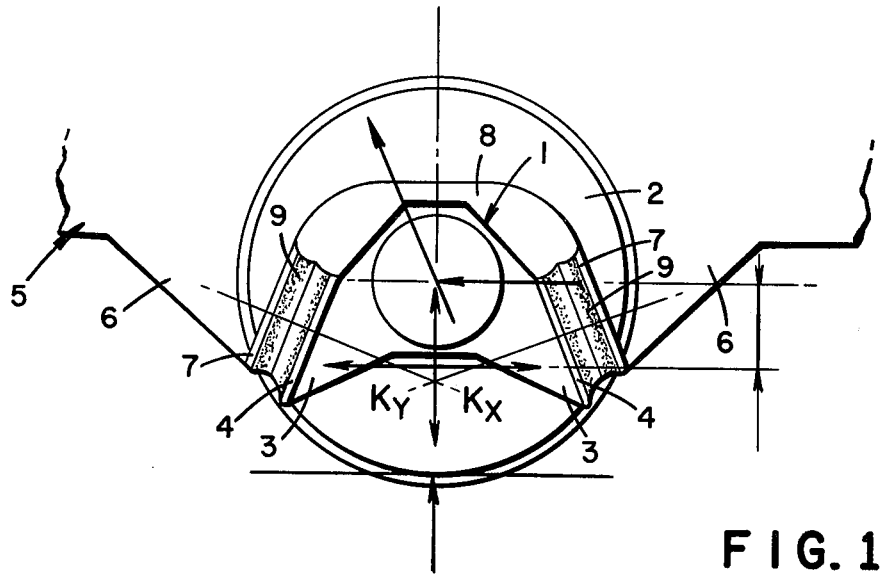
Figure 2:
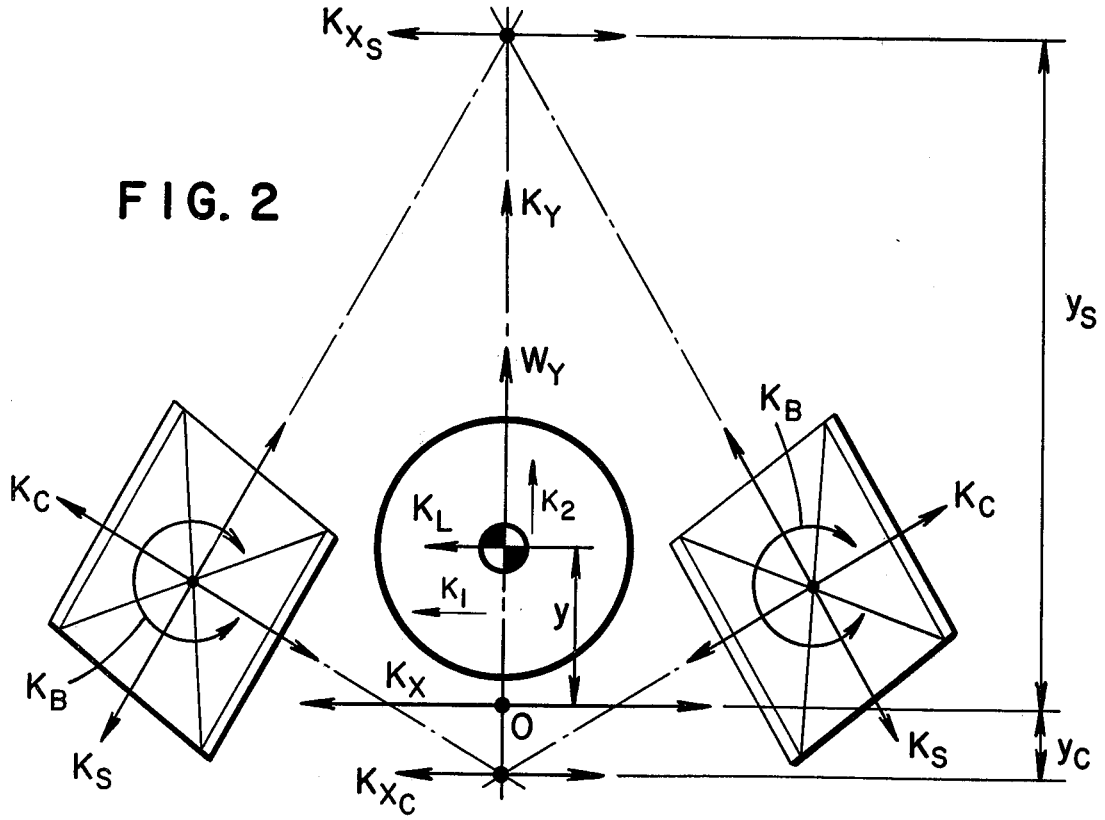

Other aspects of the invention will be made apparent in the following description of one embodiment of the invention, by way of example only, in conjunction with the diagrammatic drawings in which:

FIG. 1 is a side elevation of the primary suspension for one end of an axleset of a vehicle; and FIG. 2 shows the geometrical arrangement of the stiffness components of the suspension.

The suspension of FIG. 1 is for a single axlebox 1 which supports an end of a wheel and axleset 2 in conventional manner. The axlebox 1 has provided a downwardly projecting extension 3 at each side and each extension 3 has a substantially flat spring abutment face 4. The abutment faces 4 are each inclined to the vertical as shown.

A vehicle sideframe 5, extending longitudinally of the vehicle has a pair of downward extensions 6 which provide outer spring abutment faces 7 which are substantially parallel to and spaced-apart from the abutment faces 4 on the axlebox. The sideframe has a generally U-shaped cut-out 8 to allow clearance for the axlebox 1.

A pair of rubber springs 9 are provided one between each pair of opposed abutment faces 4 and 7. Each spring 9 comprises two rubber blocks and an interleaving plate.

The rubber springs 9 are thus loaded in shear and compression when supporting the vehicle, and the components of the stiffness of the suspension at the axle in the longitudinal and vertical directions of the vehicle are $K_L$ and $K_Y$ respectively. FIG. 2 shows the stiffness components which interact to produce the effective stiffness $K_L$ at the axle.

$K_L$ is made up of two stiffness components: one $K_1$ due to the rubber stiffness about O which is the point at which the plane of the longitudinal stiffness $K_X$ intersects the vertical axis through the axleset and $K_2$ due to the vertical force at the axle bearing about O.

$$K_1 = y^{-2}\,[(K_{x_s} y_s^2) + (K_{x_c} y_c^2) + (2K_{\theta})]$$

and $$K_2 = \frac{W_Y}{Y}$$

therefore about O, $K_3 = K_1 + K_2$ and $K_1$ the longitudinal stiffness at the axle equals the reciprocal sum of the direct longitudinal stiffness of the springs at the point O and the stiffness due to rotation about the point O i.e.

$$K_L = \frac{1}{K_x} + \frac{1}{K_3}.$$

However, the invention makes $y$ a substantive value e.g. 12 inches.

Thus $K_L$ the longitudinal stiffness at the axle is less than the longitudinal stiffness factor $K_x$ due to the springs themselves and the distance $y$ of the axle center line above the plane of the longitudinal stiffness $K_x$ has caused the effect. By adjustment of the distance $y$ the stiffness $K_L$ may be reduced dependent on the required suspension characteristics.

In the above equation, $K_{x_s}$ is the longitudinal stiffness due to shear; $K_{x_c}$ is the conical stiffness of a single spring; $W_Y$ is the force applied in the $y$ direction, $y_s$ is the distance of the line of action of the longitudinal stiffness due to shear $K_{x_s}$ above $K_x$; $y_c$ is the distance of the line of action of the longitudinal stiffness due to compression $K_{x_c}$ below $K_x$.

Having now described my invention, what I claim is:

1. A railway vehicle including a body and a primary suspension comprising a downwardly inclined pair of longitudinally opposed springs of elastomeric material each mounted at their lower end upon an axlebox having an axle and supporting an axleset and adapted for connection at their other end to the vehicle body wherein the axis of the axleset is substantially vertically displaced from the plane of action of the resultant longitudinal stiffness of the suspension so that the effective longitudinal stiffness at the axle is reduced.

2. A vehicle according to claim 1 wherein the axle axis is displaced vertically above the plane of action of the resultant longitudinal stiffness of the suspension.

3. A vehicle according to claim 2 wherein the axlebox has provided a downward extension at either side for mounting the springs.

4. A vehicle according to claim 3 wherein the springs of elastomeric material are chevron springs comprising V-shaped blocks of elastomeric material.

5. A vehicle according to claim 4 wherein metal interleaving plates are provided in the springs.

* * * * *